US012650280B2

(12) United States Patent
Nimoh

(10) Patent No.: US 12,650,280 B2
(45) Date of Patent: Jun. 9, 2026

(54) METHOD OF AND APPARATUS FOR ADDING DIGITAL FUNCTIONALITY TO A SCOPE

(71) Applicant: NIMOH LTD, Isleworth Middlesex (GB)

(72) Inventor: Kofi Nimoh, Isleworth Middlesex (GB)

(73) Assignee: NIMOH LTD, Isleworth Middlesex (GB)

( * ) Notice: Subject to any disclaimer, the term of this patent is extended or adjusted under 35 U.S.C. 154(b) by 0 days.

(21) Appl. No.: 18/879,905

(22) PCT Filed: Aug. 16, 2023

(86) PCT No.: PCT/GB2023/052153
§ 371 (c)(1),
(2) Date: Dec. 30, 2024

(87) PCT Pub. No.: WO2024/038272
PCT Pub. Date: Feb. 22, 2024

(65) Prior Publication Data

US 2025/0334375 A1 Oct. 30, 2025

(30) Foreign Application Priority Data

Aug. 16, 2022 (GB) ..... 2211963

(51) Int. Cl.
*F41G 1/473* (2006.01)
*F41G 1/38* (2006.01)
(Continued)

(52) U.S. Cl.
CPC ..... *F41G 1/473* (2013.01); *F41G 1/38* (2013.01); *F41G 3/08* (2013.01); *F41G 3/16* (2013.01)

(58) Field of Classification Search
CPC ... F41G 1/38; F41G 1/473; F41G 1/54; F41G 3/06; F41G 3/08; F41G 3/16; F41G 3/32; H04N 23/63
(Continued)

(56) References Cited

U.S. PATENT DOCUMENTS 9,113,061 B1 8/2015 Morley
9,593,907 B2 * 3/2017 Regan ..... F41G 1/30
(Continued)

FOREIGN PATENT DOCUMENTS

WO 2015/199780 A2 12/2015
WO 2022/063344 A2 3/2022

OTHER PUBLICATIONS

International Search Report and Written Opinion, PCT/GB2023/052153, dated Oct. 27, 2023 (13 pp.).
(Continued)

*Primary Examiner* — Troy Chambers
*Assistant Examiner* — Benjamin S Gomberg
(74) *Attorney, Agent, or Firm* — Eversheds Sutherland (US) LLP

(57) ABSTRACT

A method of adding digital functionality to a scope. A scope reticle from the scope is aligned with a virtual reticle from a digital overlay of an electronic display device coupled to the scope. The scope reticle is present in a first coordinate space of the scope image and the virtual reticle is present in a second coordinate space. The alignment of the reticles maps the first coordinate space to the second coordinate space. The coordinate spaces are then locked and the virtual reticle is made invisible, switching from a configure mode to an operate mode. Digital functionality can then be provided to the scope via the digital overlay. This may include an aiming indicator which works with the scope reticle.

20 Claims, 7 Drawing Sheets

(51) Int. Cl.
*F41G 3/08* (2006.01)
*F41G 3/16* (2006.01)

(58) Field of Classification Search
USPC ..... 42/122
See application file for complete search history.

(56) References Cited

U.S. PATENT DOCUMENTS

| | | | | |
|---|---|---|---|---|
| 2016/0091282 | A1* | 3/2016 | Baker | H04N 23/661 348/158 |
| 2016/0290765 | A1* | 10/2016 | Maryfield | F41G 1/30 |
| 2018/0039061 | A1 | 2/2018 | Hairston et al. | |
| 2022/0404121 | A1* | 12/2022 | Loebig | F41G 1/38 |
| 2023/0080906 | A1 | 3/2023 | Lv | |

OTHER PUBLICATIONS

GB Search Report in GB2211963.0 dated Feb. 17, 2023 (4 pp.).
GB Search Report in GB2312529.7, dated Jan. 26, 2024 (5 pp.).
GB Examination Report in GB2312529.7, dated Aug. 21, 2024 (4 pp.).

* cited by examiner

METHOD OF AND APPARATUS FOR ADDING DIGITAL FUNCTIONALITY TO A SCOPE

CROSS-REFERENCES TO RELATED APPLICATIONS

The present application is a national phase filing of International Application No. PCT/GB2023/052153, filed on Aug. 16, 2023.

TECHNICAL FIELD

The present specification relates to a method of adding digital functionality to a scope. The present specification also relates to an apparatus for putting the method into effect, as well as to a computer program product (for example, a software application) for doing the same.

BACKGROUND

Digital camera based tools are known for overlaying ballistics information to provide the shooter with additional information. Additionally, some of these tools have been developed to assist the aim of the shooter, with some setup to control the trigger operation so that the trigger is only fully operated when the gun is accurately targeted on a target.

There is a desire to provide a digital camera based tool, for example, a software application or other computer program product which can be run on a smartphone or similar, which can be used in conjunction with a conventional scope with a scope reticle (e.g., a stadiametric reticle) to provide additional range or other information to assist the operator. This may be, for example, targeting information which takes into account the weather conditions within the range of view or provides other ballistics or range information that might be useful to the operator.

SUMMARY

Viewed from a first aspect, there can be seen to be provided a method of adding digital functionality to a scope as defined in claim 1. The method comprises aligning a scope reticle of the scope with a virtual reticle of an electronic display device during a configure mode, to allow digital functionality from the electronic display device to be added to an output from the scope. The visibility of the virtual reticle is then reduced in an operate mode to reveal the scope reticle for the operator.

The method uses an image, for example, of a blank area, which is being viewed through the scope, the image being displayed on an electronic display of an electronic display device for an operator to view. The electronic display device has a digital camera that has been coupled to an ocular lens of the scope. The electronic display device may be mounted in place on the scope, for example, through using mounts on the scope to hold the electronic display device and its camera in position over the ocular lens. The method of aligning an output from the scope and a virtual output from the electronic display device comprises:

- directing the scope to produce an image output at the ocular lens of the scope that is received by the camera, the scope adding a scope reticle to the image;
- displaying the image on the electronic display, the image being displayed in a first coordinate space;

- generating a digital overlay for the electronic display that includes a virtual reticle which is visible to the operator in the configure mode, the digital overlay being displayed in a second coordinate space;
- combining on the electronic display the digital overlay in its second coordinate space with the image output from the scope in its first coordinate space;
- allowing dimensional and/or positional adjustment of the first coordinate space relative to the second coordinate space to align the scope reticle with the virtual reticle in the digital overlay, so that the virtual reticle becomes aligned with the scope reticle in the configure mode;
- locking the first coordinate space of the image output from the scope to the second coordinate space of the digital overlay; and
- reducing visibility of the virtual reticle in the digital overlay with respect to the image output from the scope in an operate mode in order to reveal the scope reticle on the electronic display for the operator.

Through the method, the first coordinate space is aligned to the second coordinate space using the reticles and locked to allow the electronic display device, through the digital overlay, to add information for the benefit of the operator. The information is then able to move with the targeting of the scope. In this way the scope can become a 'smart scope' where supplemental range finding functionality, targeting functionality and/or other digital functionality can be added to the scope.

The method may include integrating information into the digital overlay that is visible to the operator in the operate mode, when the first coordinate space of the image output from the scope is locked with the second coordinate space of the digital overlay from the electronic display device, to assist the operator in range determination or targeting determination, for example, though the provision of an aiming indicator for use with the scope reticle.

The scope is preferably directed at a blank area (e.g., a wall or screen) during the configure mode and so the image output from the scope on the electronic display of the electronic display device is of the blank area with the scope reticle, for example, as the operator would see the blank area looking through the ocular lens of the scope normally, with the scope reticle (e.g., crosshairs) superimposed on the blank scope image.

The electronic display device may be configured to provide a window in the digital overlay with a camera viewscreen, for example, a real time display of the output from the scope, showing the image with the scope reticle as seen through the digital camera.

The scope may be a conventional scope, as used for targeting, range finding or surveying operations. The electronic display device may be a conventional smartphone, for example, with a touchscreen display. However, this is not to exclude the possibility of a purpose-built scope device which incorporates an electronic display device to output a modified scope output with the additional digital functionality at the eye-piece for the operator.

The additional information carried in the digital overlay may include an aiming indicator in the second coordinate space of the digital overlay that becomes mapped to the first coordinate space through the locking of the first and second coordinate spaces, such that the aiming indicator moves with the first coordinate space in common with changes at the scope in order to provide a virtual aim point for the scope reticle. With the visibility of the virtual reticle reduced, the operator sees the scope image with the scope reticle, which may now be trained towards a target, with information like the virtual aim point provided over the scope image to upgrade the functionality of the scope to that of a smart scope.

The additional digital functionality may be provided by generating an overlay signal carrying the digital overlay. The overlay signal includes the virtual reticle, at least in the configure mode, and preferably also in the operate mode if its opacity is reduced to zero or so close to zero that it is no longer seen by the operator. The overlay signal may also include other portions of the digital overlay that the operator sees as the screen display of the electronic display device, for example, numerical information and/or symbolic information to assist the operator in, for example, targeting, determining distances or measuring dimensions of objects. The overlay signal may also carry other portions of the screen display, for example, provide regions within the display where a camera viewfinder is positioned, e.g., where the signal feed from the electronic display device is fed as a real time display in the digital overlay, as well as providing other regions on the screen where there may be mini-displays and/or electronic gadgets for the operator to use as part of the of the digital functionality of the software application.

Since the aiming indicator is provided in the second coordinate space of the digital overlay that becomes mapped to the first coordinate space through the locking of the first and second coordinate spaces, the aiming indicator is able to move with the first coordinate space in common with changes at the scope in order to provide a virtual aim point for the scope reticle. The virtual reticle at that stage (in the operate mode) is no longer visible to the operator, so the display in a camera viewscreen is one of the image as seen through the scope, with the scope reticle aligned in the camera viewscreen, with the additional digital functionality provided by the digital overlay working in tandem with the operations of the scope. In effect it provides smart scope functionality via the electronic display device.

A position for the aiming indicator in the second coordinate space may be determined based on a current target position of the scope and on parameters input to the electronic display device which may alter the aim point for the operator. The software application running on the electronic display device may comprise the usual ballistics functionality which is available through existing products where weather (e.g., wind speed, wind direction, temperature, etc.) and/or atmospheric conditions (e.g., humidity, atmospheric pressure, etc.) are fed into the application, either manually or electronically, and algorithms are run to determine the effect these will have on projectiles fired over a target distance. Details of the projectile (e.g., calibre, make, finish, etc.) and firearm (e.g., type, make, calibre, condition, etc.) may also be input into the application to complete the parameters for the algorithm variables. Using current targeting information, e.g., from the direction of the scope, the distance to the target, etc., the effect of the weather and/or atmospheric conditions can be applied to those situations and the change required on the aim point can be determined. Thus, an aim point in the second coordinate space can be determined via a ballistics engine part of the software application. The aiming indicator can then display a virtual aim point, for example, via a pair of crosshairs, in the second coordinate space for the operator to use in conjunction with the scope reticle in the first coordinate space.

Thus, the method may include inputting parameters which are indicative of weather conditions and/or atmospheric conditions between the scope and a target, and/or of ballistic properties of a projectile to be fired at the target. Having input these parameters, they are used to determine a position of the aim point in the second coordinate space.

The digital functionality provided to the scope may go beyond the aiming indicator described above. For example, the information may comprise a virtual tool for assisting with range determination. The virtual tool may allow dimensions to be measured in the first coordinate space via the second coordinate space and may specify the measured dimensions on the electronic display in units relevant to the first coordinate space. For example, milliradian distances can be measured through the mapping of the first coordinate space to the second coordinate space and these can be converted into units of distance such as yards and inches (or metric equivalents as desired) and incorporated into a display for the operator.

In one embodiment a virtual tool is represented in the second coordinate space as a virtual 'caliper' tool. The virtual caliper tool may comprise a pair of virtual caliper arms which can be used to measure a dimension of a physical object of known size which is visible in the image. A measurement from the virtual caliper tool can be determined in the second coordinate space and mapped to the first coordinate space, due to the locking of the coordinate spaces. A distance to the object may be determined from the measured dimension using the known size of the physical object and a scaling factor used for mapping dimensions in the first coordinate space to the second coordinate space.

In another embodiment, rather than (or in addition to) a virtual caliper tool, an object within the image can be selected, for example, by clicking on an area of a screen or by encircling the object within an on-screen selection tool (e.g., a rectangle, circle, etc.), the selected object can be recognised via an artificial sub-routine, for example, by using an artificial intelligence (AI) engine which is able to recognise objects in images, the dimensions of the recognised object can be looked up automatically, for example, using automated internet based resources, and the looked-up dimensions can be used to assess a distance in the second coordinate space corresponding to the selected object, in order to map onto the first coordinate space and scale the virtual reticle with reference to a physical object in the image accordingly. An automated method may include steps of recognising an object selected in the image, using a name of the recognised object as a search term and looking up dimensions of the product (such as a length, width, height, diameter, radius, opening size, etc.), and using one or more such dimensions to gauge a distance in the image, in particular to assess a range measurement.

As described above, the virtual reticle is visible to the operator during the configure mode and is switched to being invisible to the operator during the operate mode.

The reducing visibility of the virtual reticle may be performed by switching off or switching out the virtual reticle from an overlay signal so that it no longer appears in the digital overlay. The virtual reticle may be created from an image model that can be switched off from a set of image models used to construct the digital overlay. The virtual reticle may be created from an image model provided in one channel that is mixed with a signal for a remainder of the digital overlay, such that it can be switched out by selecting different channels prior to mixing.

The reducing visibility of the virtual reticle may be performed by transforming the virtual reticle from an opaque reticle to a transparent reticle in the digital overlay. For example, an opacity percentage assigned to the virtual reticle (e.g., as an image model) may be reduced. Preferably such an opacity percentage is reduced to less than one, for example, to zero. However a reasonable effect may still be seen with reducing the opacity percentage to 5% or 10%, or at least to an extent that the virtual reticle is no longer visible to the operator, and these options are all envisaged within the present disclosure.

The reducing visibility of the virtual reticle may be performed by reducing a line thickness of the virtual reticle relative to the scope reticle, such that the virtual reticle may then fit entirely within an outline of the scope reticle. In this way, and/or preferably by changing a colour of the virtual reticle from a contrasting colour to a matching colour of the scope reticle, the operator may be tricked into only seeing the scope reticle.

The scope reticle may be produced by an image marked on part of a lens system within the scope. For example, it may be a pattern of fine lines, dots, symbols or other markings built into the ocular lens (eyepiece) of the scope, usually in a crosshair pattern, provided by engraving, etching, coating, or some other form of permanent marking. The scope reticle may appear dark or preferably black in the image output from the scope under normal viewing. However, the scope reticle may also include a pigment or structural effect that can produce or reflect a colour, e.g., from a light source, to provide a coloured line, mark, symbol, or other part of a scope reticle, for the operator to observe more easily. For example, the scope reticle may be configured to provide red lines or other such markings or effects that can appear for low light use or night use. Red tends to be the least destructive to an operator's night vision and so is often used for scopes, but green and yellow are other popular choices for low light or night use and other colours may become more fashionable from time to time, all such colours being within the present disclosure.

The scope reticle may be a stadiametric reticle, for example, where the markings of the stadiametric reticle indicate precise distance measurements within the image such as angular distance measurements, e.g., milliradian. The stadiametric reticle may consist of just lines and/or dots, or it may comprise lines and/or dots and include other marks like chevrons, circles, numbers, letters, symbols, etc., to assist the operator in targeting or otherwise using the scope. The lines of the scope reticle may include a combination of regions of thicker line portions and thinner line portions, where the transition from thicker to thinner line portions may provide visual indicators of a distance along the stadiametric reticle axis.

The scope may be a telescope, for example, for a rifle (i.e., a riflescope). The scope may also have some other primary function which is not specific to shooting, for example, range finding or surveying. The scope may include mounts for mounting an electronic display device, such as a smartphone with a touch screen, to the scope. The apparatus would usually comprise an assembly of a scope and an electronic display device, but it is also envisaged that the apparatus may take the form of an optics device that can be mounted to a stand or rifle that comprises a scope and an integrated electronic display device, e.g., as a single piece of equipment.

In its simplest form the camera may be a digital camera on the back of an electronic display device, such as a smartphone. Smartphones often comprise multiple digital cameras and mounts on the scope may be set up to align and hold at least one of the digital cameras to the ocular lens of the scope. The virtual reticle may be provided by a programmable digital camera reticle function on such an electronic display device, for example, through a smartphone software application. Where desirable, other types of electronic display device may also be used, such as a tablet or laptop, and the digital camera may be a separate digital camera that is mounted on the ocular lens of the scope and digitally coupled with the electronic display device.

The method can also be seen as a way of mapping a digital output from a software application provided on an electronic display device like a smartphone with an image that is output from a scope, such as, but not exclusively, a rifle scope. Once mapped, the electronic display device can provide additional digital functionality to the scope for the operator.

The disclosure, at least in preferred embodiments, can also be seen as relating to a method for a digital camera based tool, for example, a software application that, when loaded on a smartphone or other such electronic display device, is able to incorporate a virtual stadiametric reticle with, for example, subtension measurements that can precisely match those of a physical telescope stadiametric reticle. It can provide a virtual representation of a stadiametric reticle in the output from the digital camera so that the actual physical reticle of the telescope can be aligned precisely. This allows the first coordinate space to be mapped to the second coordinate space in a way to enable a programmable digital camera application, such as an application on a smartphone, to perform highly accurate aiming and range-finding functions. In short, it can be seen as providing a way for a software application to convert a conventional telescope into a smart scope, for example, by providing an aiming indicator and/or additional ballistics, targeting and range finding functionality.

The method may include selecting a virtual reticle from a database of virtual reticles.

Scope reticles tend to vary from manufacturer to manufacturer, as well as from scope to scope within a manufacturer's range. Such a database may comprise, say, a database of over 50 different virtual reticles. These may be stored with indexes to allow filtering according to at least a name of a manufacturer and/or model number. More preferably the database may comprise over 100 different virtual reticles, and more preferably still, over 250 different virtual reticles.

The virtual reticles may be exact images of known scope reticles (albeit they may be stored as a different colour to contrast with the scope reticle). An exact image provides more points of matching of the reticles for the operator to align properly the scope reticle with the virtual reticle. However, it is also envisaged that the virtual reticles may take only one or more key portions of the scope reticle, such as end points or stadiametric markings, or differ in some other minor way but still be sufficient to allow an alignment of the first and second coordinate spaces using the reticles to be performed, albeit possibly with less precision than might be achieved with exactly matching reticles.

Each virtual reticle, like its scope reticle counterpart, may comprise an x-axis indicator and a y-axis indicator. Together these may be in the form of 'crosshairs', made up of lines, a series of dashes or dots (e.g., a string of regularly spaced dots), or a combination of any of these. The dimensional extent of x-axis and y-axis indicators, or portions of such indicators, may therefore define a set distance in the second coordinate space in the x-and y-dimensions respectively. The virtual recticles may comprise dots and/or lines along the axis lines to indicate corresponding stadiametric equivalent distances.

Typically, the scope reticle will appear in black or other dark colour over the scope image for at least daylight conditions. The corresponding virtual reticle may be provided in a contrasting colour, for example, a lighter colour which can contrast with a dark colour of the scope reticle.

Indeed a colour of the virtual reticle, when building a database of virtual reticles, may be selected as a contrasting scope colour on the basis of the colour of the scope reticle it is intended for. A code for the virtual reticle may be linked to one or more codes prescribing one or more colours for the virtual reticle. The database may comprise several virtual reticles for a given make and model of scope, e.g., one for daylight, one for low light and one for night use, the only real difference being the colour of the virtual reticle. The operator may be given the option to select a specific colour of virtual reticle from a list, or the colour may be selected automatically according to light levels detected in the image output from the scope.

Thus at least in preferred embodiments, the virtual reticle may be selected from a drop-down list presented to the operator, for example, a list categorised by manufacturer and scope model number. The virtual reticle may, however, be selected from data input by the operator, such as data providing an indication of the scope being used. The data may be supplied to the electronic display device (smartphone) with little or no input required from the operator, e.g., through one or more of recognition of a barcode on the scope to collect the manufacturer and/or model information, through knowledge of the purchase of the scope (e.g., through an electronic register or cookies), or through a saved previous preference when the electronic display device is re-connected to the scope. The electronic display device, once coupled with its digital camera coupled to the ocular lens of the scope, could also include a software routine to recognise the scope reticle through image recognition and select a matching virtual reticle from its database for the operator.

The virtual reticle may be selected on the basis of it matching a format of the scope reticle. While the virtual reticle is preferably selected on the basis of being identical in format to the scope reticle, the virtual reticle may be selected on the basis that at least certain features of the virtual reticle match the scope reticle, such as the origin to end point distances on the x-and y-axes.

For example, the virtual reticle and the scope reticle may each comprise an x-axis indicator and a y-axis indicator, each of the axis indicators may include one or more lines with a line thickness, and optionally there may be stadiametric scale markers, for example, in the form of lines, dots or other symbols. Matching a format of the scope reticle may be based on one or more of: a match of the virtual and scope reticle axis indicators in an x-direction and/or a y-direction; a match of the virtual and scope reticle scale markers in an x-direction and/or a y-direction; and/or a match of the virtual and scope reticle line thickness in an x-direction and/or a y-direction.

In a preferred case where a database of virtual reticles is provided for the operator, the database preferably includes virtual reticles that exactly match scope reticles of commercially available scopes. In this way the alignment of the virtual reticle with the scope reticle becomes an easier task for the operator. The operator can focus their eye on any part or all of the virtual/scope reticles and judge easily when the position and dimensions are a good match. The easier this task is made the more accurate the alignment of the reticles can be, and consequently the more accurate the alignment of the first coordinate space will be with the second coordinate space.

The selecting may also be performed, in part or completely, automatically. This may be through determining a make and/or model of the scope from data stored in an operator profile file, using an image recognition routine on the scope reticle in the image output from the scope when coupled to the electronic display device, using an image recognition routine on an image of the scope seen through the digital camera before coupling the electronic display device to the scope, or scanning a barcode, QR code or other mark using the digital camera of the electronic display device to identify the scope.

The allowing adjustment of the first coordinate space relative to the second coordinate space may comprise allowing adjustment of the dimensions (scaling) of the first coordinate space relative to the second coordinate space and/or allowing repositioning of the first coordinate space relative to the second coordinate space. In other words, the adjustment may include dimensional adjustment of an x-axis dimension independently of any y-axis dimension and/or may include rotational repositioning of the first coordinate space relative to the second coordinate space, and may include adjustments like keystone transformations. The virtual reticle of the second coordinate space may be displayed in a circular camera viewscreen region and the image from the scope may be circular too, and the adjustments may comprise aligning the two circular regions, for example, using crosshairs from the scope reticle and the virtual reticle to assist.

The alignment of the scope reticle with the virtual reticle can be performed through one or more types of screen gesture performed on the electronic display of the electronic display device. These may be common movements associated with the operation of smartphones, such as two finger movements to expand and/or contract the first coordinate space with respect to the second coordinate space, and perhaps single or two finger drag movements to re-position the first coordinate space with respect to the second coordinate space. The alignment of the scope reticle with the virtual reticle may also be performed using virtual buttons to expand and contract the first coordinate space with respect to the second coordinate space, and virtual buttons such as arrow buttons to re-position the first coordinate space with respect to the second coordinate space. Slider bars or other virtual tools may be provided for the operator to perform keystone and other transformations, for example. Indeed other methods of an operator interfacing with an electronic display device may become popular as new devices come onto the market and these could be used with the described method.

Once the operator is satisfied that the scope reticle is properly aligned with the virtual reticle, the operator can switch out of a configure mode (i.e., a set-up mode) into an operate mode (i.e., a use mode).

The virtual reticle is preferably displayed over the scope reticle in at least a configure mode. When the operator switches to operate mode, the visibility of the virtual reticle is reduced such that it can no longer be seen by the operator, and in so doing reveals the scope reticle for the operator.

In the operate mode, the second coordinate space of the digital overlay is locked to the first coordinate space of the image which is output from the scope. The second coordinate space becomes locked to the first coordinate space in a dimensional sense and in a positional sense such that dimensions and movements in one coordinate space can be mapped to the other.

Locking the first coordinate space to the second coordinate space may comprise digitally linking coordinates from the first coordinate space to coordinates from the second coordinate space, such that a scaling factor becomes set for mapping the coordinates of the first coordinate space onto coordinates of the second coordinate space.

During the configure mode, the scope may be directed at a blank area such as a wall or a screen by the operator to produce an image with the scope reticle added without the complexity of a target in view. The method may require directing the scope at a blank area and then re-directing the scope at a target once the first coordinate space has been locked to the second coordinate space in the operate mode.

In the present disclosure, the digital camera may be coupled to the scope by using mounts on the scope to hold the electronic display device and its digital camera in position over the ocular lens of the scope. The mounts may be adapted to accommodate recoil from a rifle firing a projectile while holding the electronic display device. The method may include a step of positioning the electronic display device in the one or more mounts of the scope to hold the digital camera of the electronic display device against the ocular lens of the scope.

Viewed from a second aspect the present disclosure also provides apparatus comprising an electronic display device which has been programmed with a computer program product for adding digital functionality to a scope. The electronic display device comprises a digital camera and an electronic display for an operator to view. The electronic display device is mountable on a scope to capture an output from an ocular lens of the scope to display on the electronic display in a first coordinate space. The ocular lens of the scope is provided with a scope reticle such that the output from the ocular lens comprises an image with the scope reticle. The computer program product is configured to control the electronic display device to add the digital functionality to the scope output observed on the electronic display through: generating a digital overlay for the electronic display device that includes a virtual reticle which is visible to the operator in a configure mode of the electronic display device, the digital overlay being displayed in a second coordinate space; combining the digital overlay in its second coordinate space with the output from the scope in its first coordinate space; allowing dimensional and/or positional adjustment of the first coordinate space relative to the second coordinate space so that the scope reticle becomes aligned with the virtual reticle in the digital overlay in the configure mode; locking the first coordinate space of the image output from the scope to the second coordinate space of the digital overlay; and reducing visibility of the virtual reticle in the digital overlay with respect to the image output from the scope in an operate mode in order to reveal the scope reticle on the electronic display for the operator.

The preferred features described above in relation to the method of the first aspect apply equally to the apparatus of the second aspect, i.e., the programmed electronic display device. Corresponding features can be combined with the apparatus of the second aspect in any combination consistent with the method features described above.

Viewed from a third aspect the present disclosure also provides an apparatus for adding digital functionality to a scope. The apparatus comprises a scope, an electronic display device and a computer program product. The scope has an ocular lens, the scope being provided with a scope reticle such that an output from the ocular lens of the scope comprises an image with the scope reticle. The electronic display device comprises a digital camera and an electronic display for an operator to view, the electronic display device being mountable on the scope to capture the output from the scope to display on the electronic display in a first coordinate space. The computer program product is configured to be run by the electronic display device and is configured to add digital functionality to the scope output observed on the electronic display. The computer program product is configured to generate a digital overlay for the electronic display device that includes a virtual reticle which is visible to the operator in a configure mode, the digital overlay being displayed in a second coordinate space. The computer program product is configured to combine the digital overlay in its second coordinate space with the output from the scope in its first coordinate space in the electronic display. The computer program product is configured to allow dimensional and/or positional adjustment of the first coordinate space relative to the second coordinate space so that the scope reticle becomes aligned with the virtual reticle in the digital overlay in the configure mode. The computer program product is configured to then be able to lock the first coordinate space of the image output from the scope to the second coordinate space of the digital overlay. The computer program product then reduces visibility of the virtual reticle in the digital overlay with respect to the image output from the scope in an operate mode of the electronic display device in order to reveal the scope reticle on the electronic display for the operator.

The preferred features described above in relation to the method of the first aspect apply equally to the apparatus of the third aspect, i.e., the assembly of the scope and the electronic display device which has been programmed with the computer program product). Corresponding features can be combined with the apparatus of the third aspect in any combination consistent with the method features described above.

Viewed from a fourth aspect the present disclosure also provides a computer program product, which when run on a programable electronic display device, is configured to add digital functionality to a scope. The computer program product is configured to align a scope reticle from the scope with a virtual reticle from the electronic display device. An image from the scope is displayed on an electronic display of the electronic display device for an operator to view. The electronic display device has a digital camera that has been coupled to an ocular lens of the scope. The scope produces an image output at the ocular lens of the scope that is received by the camera, the scope adding a scope reticle to the image. The computer program product is configured to display the image on the electronic display, the image being displayed in a first coordinate space, to generate a digital overlay for the electronic display that includes a virtual reticle which is visible to the operator in a configure mode, the digital overlay being displayed in a second coordinate space, to combine on the electronic display the digital overlay in its second coordinate space with the image output from the scope in its first coordinate space, to allow dimensional and/or positional adjustment of the first coordinate space relative to the second coordinate space to align the scope reticle with the virtual reticle in the digital overlay, so that the virtual reticle becomes aligned with the scope reticle in the configure mode, to lock the first coordinate space of the image output from the scope to the second coordinate space of the digital overlay, and to reduce visibility of the virtual reticle in the digital overlay with respect to the image output from the scope in an operate mode in order to reveal the scope reticle on the electronic display for the operator.

The preferred features described above in relation to the method of the first aspect apply equally to the computer program product of the fourth aspect. Corresponding features can be combined with the computer program product of the fourth aspect in any combination consistent with the method features described above.

The computer program product may be in the form of a software application that is loaded on to the electronic display device. The process of the computer program product may be performed locally on a processor of the electronic display device or some of the steps may be performed on a cloud based system accessed by the electronic display device.

FIGURES

Certain preferred embodiments will now be described, by way of example only, and with reference to the accompanying drawings, in which.

Figure 9:
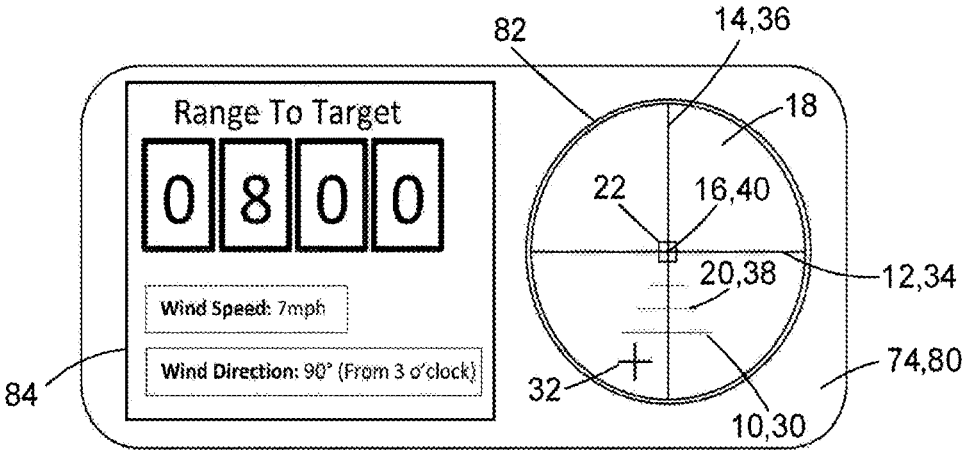
Figure 10:
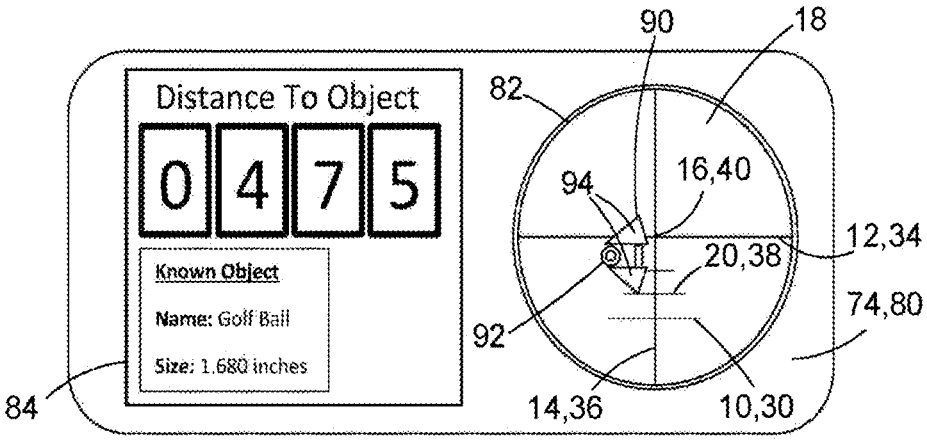
Figure 11:
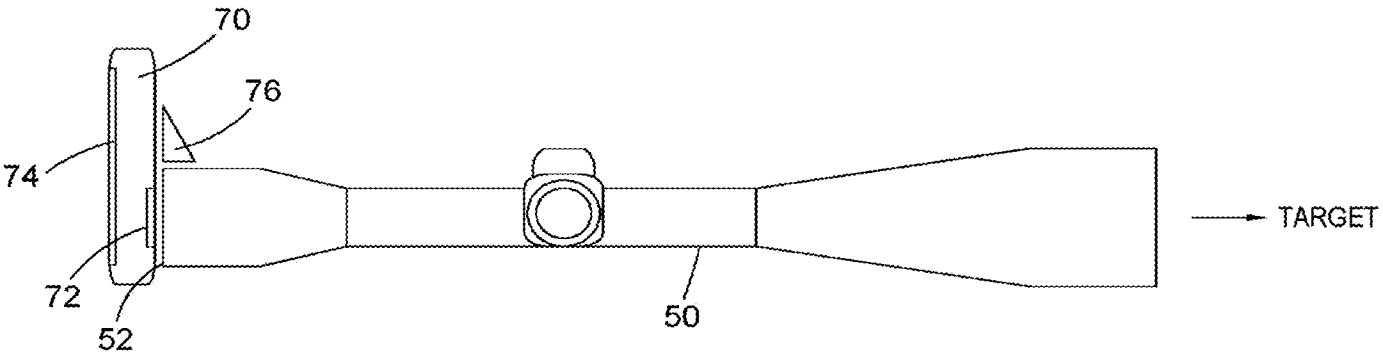
Figure 12:
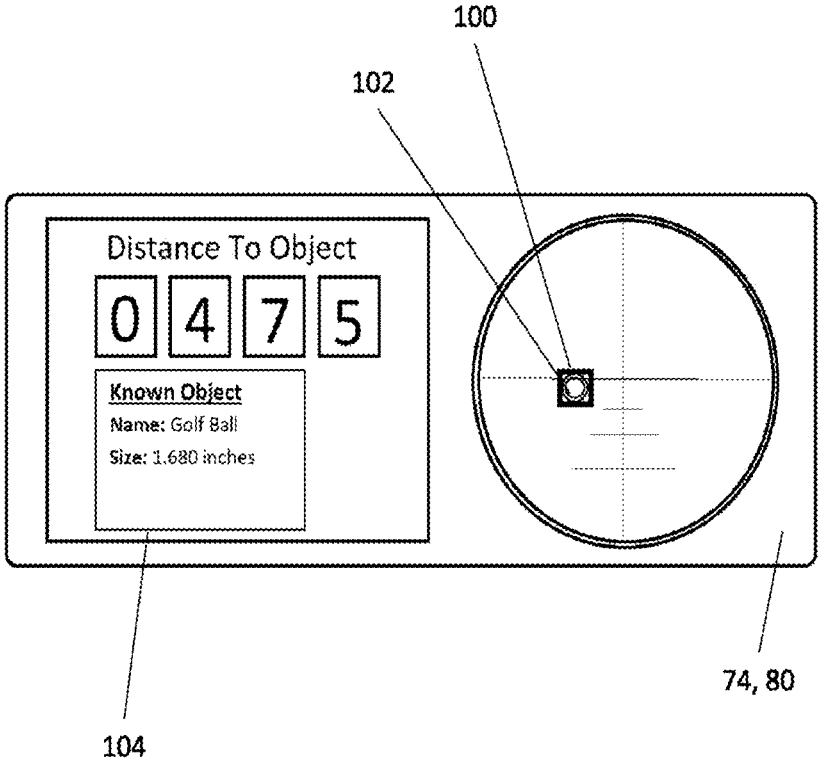

FIG. 9 is an exemplary illustration of the screen display when the smartphone application is being used as a ballistics and/or range finding application, where the camera viewscreen is displaying range and/or ballistics information and another region is displaying the telescope's ocular lens view, the telescope reticle and a virtual aiming indicator within the coordinate space of the telescope reticle;

FIG. 10 is an exemplary illustration of the screen display when the smartphone application is being used in an operate mode to assess dimensions of a target in the telescope's ocular view using a virtual caliper tool;

FIG. 11 is a schematic representation of an assembly of a telescope, in this case a riflescope, which can be fitted to a rifle, one or more mounts mounting a smartphone on the scope with the smartphone's camera directed to an ocular lens of the telescope, and the smartphone being programmed with a ballistics and/or range finding application configured as described with respect to FIGS. 3 to 10; and FIG. 12 is an exemplary illustration of the screen display when the smartphone application of a further embodiment is being used to assess dimensions based on selected objects in the image that are recognisable through AI-based recognition

DETAILED DESCRIPTION

The present disclosure has particular applicability to, though is not limited to, reticle-using riflescopes and spotter scopes (more generally referred to herein as "scope"). Over the image received from the scope, a digital, i.e., virtual, reticle can be visibly and manually configured for alignment with a reticle of the scope, in this way configuring a digital overlay in which the virtual reticle is then made invisible during use in order to provide additional functionality through the digital overlay, for example, through providing a virtual aiming indicator for the scope or a virtual rangefinder.

References herein to "visible" and "invisible" in relation to a virtual reticle viewed on an electronic display device refer to the virtual reticle as seen by the human operator (e.g., the shooter), and thus relates to wavelengths in the usual visible range of around 0.4 to 0.7 μm and whether the operator can see a virtual reticle in the image. This will be dependent on the transparency of the virtual reticle as well as its colour as compared to the scope reticle. In other words these terms are used in their normal sense: for example, that the reticle is visible to the operator or should be visible, may also depend on the background and light conditions, or in the opposite scenario is invisible to the operator in the sense that the reticle can no longer be distinguished or is so close to being invisible that it is not noticeable or distracting to the operator when the operator is using the digital camera based tool.

A stadiametric reticle is a crosshair for aiming or rangefinding utilising multiple markings usually in the form of lines and/or dots spaced out at regular angular units, the most common angular unit of which is termed the angular 'mil'. Other angular units such as the 'Minute of Angle' (MoA), and 'Inches per Hundred Yards' (IpHY) are also used and the 'mil' itself, a loose abbreviation of the angular measurement 'Milliradian' is defined differently according to various use-cases.

All the various angular unit measurements can be converted between each other. A common basic riflescope/range-finding spotting scope reticle is known as the 'Mil-Dot' or 'Mildot' reticle.

Figure 1:
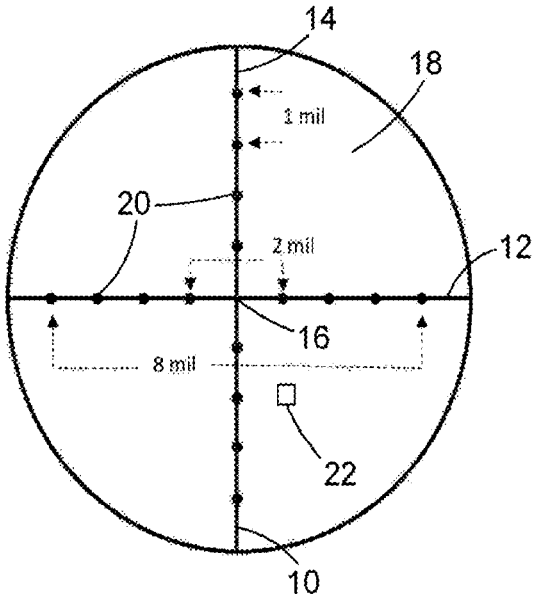
FIG. 1 (PRIOR ART)
FIG. 1 is an illustration of an exemplary view of a stadiametric reticle, e.g., in the form of a Mildot reticle.

FIG. 1 shows an illustration of a view down an ocular lens 52 of a scope 50, showing an exemplary stadiametric recticle 10 provided by the scope 50. In the example of FIG. 1, the scope reticle 10 comprises an x-axis crosshair 12 and a y-axis crosshair 14, and there is a point in the centre 16 of the image 18 where the crosshairs 12,14 pass over one another to form a cross which can be used to gauge the true direction to a target (when set up correctly) and so provide a central aiming point 16.

A Mildot reticle, as shown, is usually characterised by a series of dots 20 on both the vertical and horizontal crosshairs 12,14, where each dot 20 apart from the two most central ones on each crosshair 12,14, is spaced exactly one mil from its nearest neighbouring dot(s) 20 along the crosshair 12,14. The two most central dots on each crosshair 12,14 of the Mildot reticle 10 are two mils apart, but exactly one mil from the central aiming point 16, at least in this example.

While FIG. 1 includes a few exemplary 'mil' values (1, 2 and 8 mils) associated with the dotted lines, these are for explanatory purposes only to explain the scaling. The scaling may be based on other mil value ranges or even different units of measurement.

A marksman can utilise the Mildot reticle for accurately aiming at a target (indicated by a simple rectangle 22 in FIG. 1) based primarily on the distance away from a rifle barrel, and secondly on other factors such as wind direction and speed. These calculations are not trivial, so for the most proficient modern marksmen, use of a specialised calculator, such as a ballistics application, is required or preferred.

Many ballistics applications exist on the market, and since the advent of smartphones, many smartphone-based ballistics applications have been developed. A common feature of many smartphone ballistics applications is a quasi-reticle view, where a graphical replica, to-scale image of the users' riflescope reticle 10 is displayed on screen, with an aiming pointer 24, usually in the form of a small simple crosshair indicating where on the stadiametric reticle 10 the marksman should be aiming based on the current environmental and distance conditions.

Figure 2:
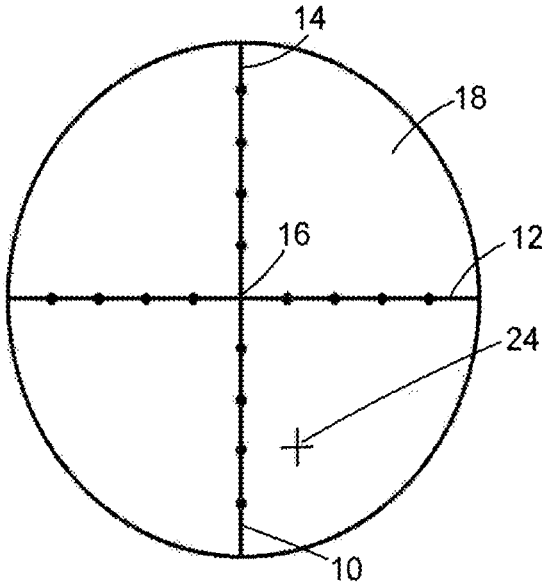
FIG. 2 (PRIOR ART)
FIG. 2 is an illustration of the exemplary stadiametric reticle of FIG. 1 with an overlay of an aiming indicator incorporated within an area of the telescope's reticle.

FIG. 2 shows an exemplary illustration of the stadiametric reticle 10 of FIG. 1 with an additional targeting crosshair (aiming indicator) 24.

In preferred embodiments of this disclosure, an image of a virtual reticle 30 is displayed on a screen 72 of an electronic display device 70 together with an image 18 output from the ocular lens 52 from the scope 50 during a 'configure' mode, to assist with aligning a digital overlay 80 (providing the virtual reticle 30) to the image 18 from the scope 50. Thus, a difference compared to the known smartphone ballistics applications is that rather than providing a quasi-reticle view, the operator is viewing the actual scope reticle, albeit as captured by the digital camera and seen in the camera viewscreen of the digital overlay 80 provided by the software application.

An overlay signal (i.e., the screen commands) for the digital overlay 80 may also provide an aiming indicator 32, to give an impression of displaying the aiming indicator 32 on the actual physical scope reticle 10, through the viewfinder of a digital camera 72 attached to the physical scope 50. The programmable digital camera 70 in question, used for this function is preferably a modern smartphone device (see FIG. 11). The manner in which it is attached to a riflescope or spotting scope is preferably through using smartphone mounts that have been developed for this purpose. Many such smartphone mounts are on the market already, and are used for mounting smartphones to riflescopes, spotting scopes, general telescopes and binoculars, often primarily for taking pictures and making video film, e.g., during firing of a rifle.

Using the method described herein, a physical scope reticle 10 can be perfectly aligned with a software reticle 30 within, for example, a ballistics and/or range-finding software application, instantly transforming an existing riflescope 50 into a smart digital riflescope.

A smart digital riflescope is one in which ballistics software is preferably integrated into the output from the scope to automatically adjust the scope reticle that would be seen, such that when it is positioned correctly relative to an output for the digital device, it is able to take into account the distance to target and environmental conditions.

A difference between a smart digital scope described herein and a conventional ballistics application attached to a non-digital scope 50 is that it is not the scope reticle 10 that is adjusted to reflect the aim point (as per a smart scope), but an aiming indicator 32, which makes use of the stadiametric scope reticle 10 to indicate to which area of the scope reticle 10 the marksman should be aiming.

Figure 3:
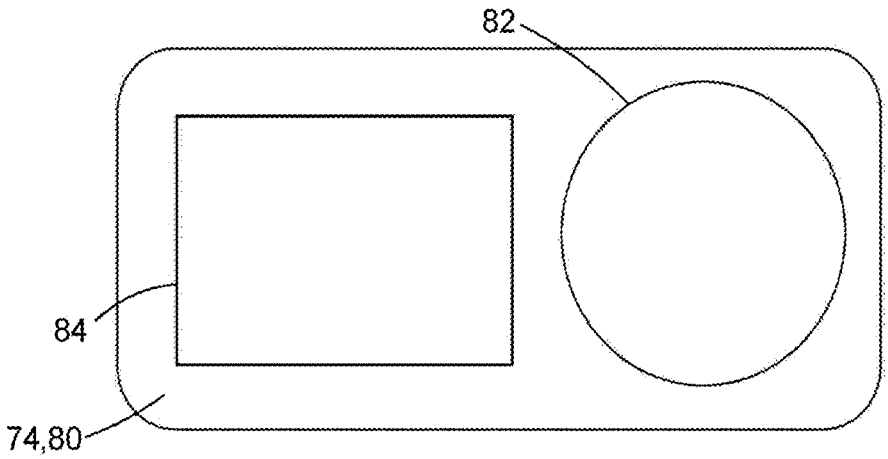
FIG. 3 is an exemplary illustration of a layout for a screen display on a smartphone running an embodiment of a ballistics and/or range finding application showing a first region for displaying ballistics and/or range information and a second region for providing a camera viewscreen where an image from the smartphone's camera can be displayed.
Figure 4:
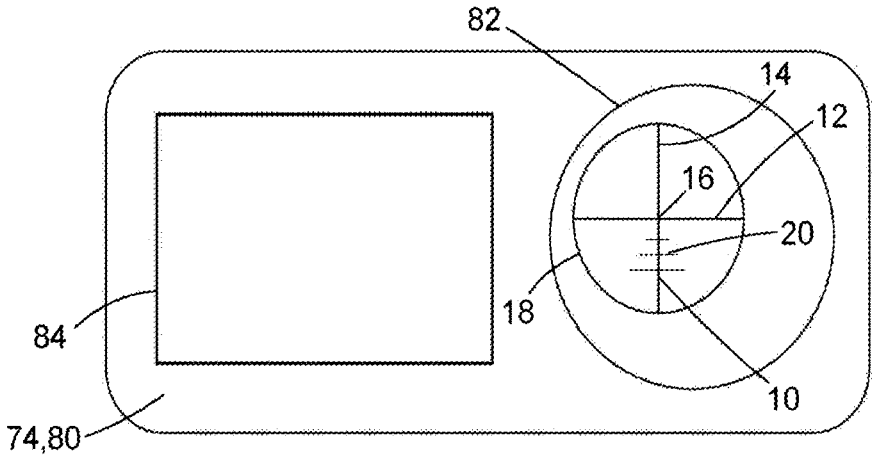
FIG. 4 is an exemplary illustration of the screen display of FIG. 3 when fitted to a telescope with the scope's ocular view and telescope reticle visible in the camera viewscreen.
Figure 5:
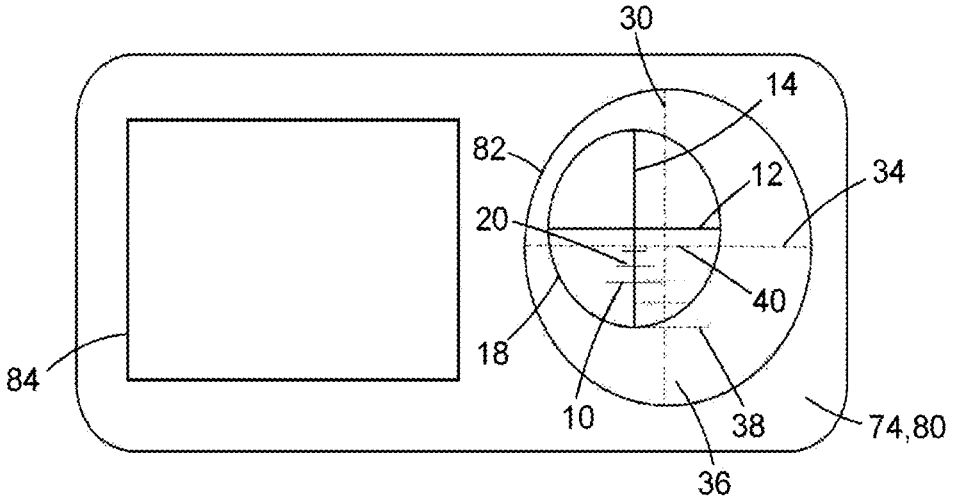
FIG. 5 is an exemplary illustration of the screen display illustrating a virtual reticle overlaid on the image in the camera viewscreen showing the telescope's ocular lens view and telescope reticle in a configure mode.

The manner in which a virtual aiming indicator 32 can be digitally super-imposed over an image of the scope reticle 10 with then accurate alignment of the actual and virtual coordinate spaces, in a preferred embodiment, is described as follows:

1. A specialised smartphone ballistics and/or range finding application may be provided as shown in FIG. 3. See also FIG. 11. A smartphone 70 is mounted to an ocular lens 52, i.e., eyepiece of a scope 50, which may be a firearm riflescope but not exclusively so. The electronic display 74 provided by the digital overlay 80 can include a first region 82, such as the circular area shown in FIG. 3, which is intended to replicate a view down a scope 50. That first region 82 is configured to be a smartphone-camera viewfinder area (camera viewscreen), showing the output of the scope image as a live feed within that first region 82. Such a camera viewscreen or first region 82 can be incorporated on the main application page of the smartphone application. In the example, in FIG. 3 the first region 82 is a circular region on the right hand side of the screen 74 but other arrangements are possible. A second region 84 or remainder of the digital overlay 80 may be used to display additional information for the operator, such as ballistics information, range information, and/or any other information that may be useful to the operator. The electronic display 74 of the electronic display device 70 is preferably a touch screen 74 of a smartphone 70, so that the touch screen functionality of the smartphone 70 can be used with the ballistics and/or range-finding application.
2. The smartphone 70 running the ballistics and/or range-finding application is mounted to a scope 50 incorporating a reticle 10 in the seen image (the "scope reticle"), for example, a reticle as seen in FIG. 1. The scope reticle 10 can be used for the purposes of aligning, both dimensionally in x and y directions and in terms of relative position on the camera viewscreen (first region) 82, the output display from the smartphone digital camera 72 through using the digital camera based tool (e.g., a smartphone software application). It is not unusual for the riflescope ocular lens 52 to be out of alignment with the independent smartphone digital camera lens 72 on an initial installation, and for the misalignment therefore to manifest itself at the camera viewscreen (first region) 82. FIG. 4 shows an example where the scope reticle 10 is out of alignment with the camera viewscreen 82.
3. To align the scope reticle 10 with the virtual reticle 30 provided by the smartphone 70, and to therefore make the scope 50 actively usable with the software application, the application is placed in a 'configure' mode. In this configure mode the virtual reticle 30 is provided in an overlay signal which generates the digital overlay 80, and the reticles are used to help the operator align the two images, namely the image 18 from the scope 50 with the scope reticle 10 and the image (the first region 82) from the software application on the electronic display device 70 which includes the virtual reticle 30. The operator may be provided with a choice of virtual reticles 30 to select from, or a selection may be made automatically for the operator based on information as to the make and model of the scope 50. The application is preferably configured to display an outline of an exact match virtual reticle 30 to the actual scope reticle 10. This may be achieved through an automated rule based on inferred scope 50 and/or reticle 10 information, operator input selecting such information, or more usually, a mixture of the two, where deduced technical information and operator inputs will steer a set-up wizard through a virtual reticle 30 selection process to achieve the match. For example, see FIG. 5 which shows a virtual reticle 30 and a scope reticle 10 which match each other in terms of their outline form, albeit not yet aligned in terms of their relative positions and dimensions (scaling).

Figure 6:
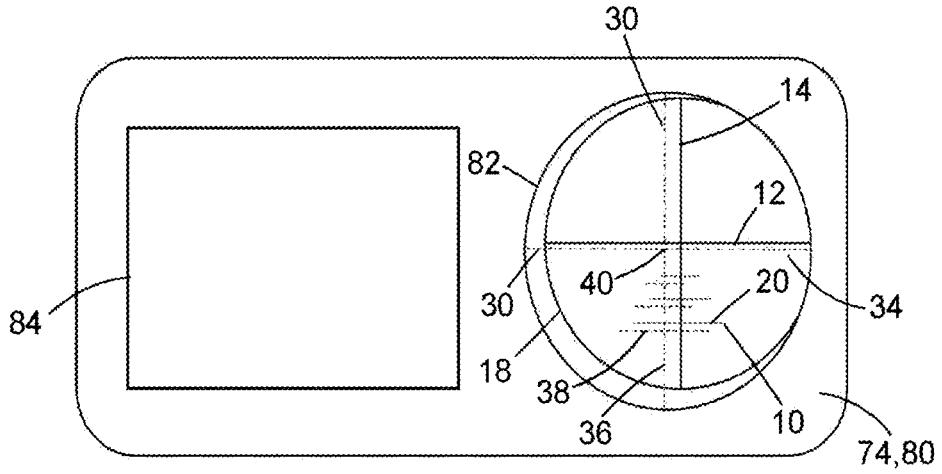
FIG. 6 is an exemplary illustration of the screen display illustrating configuring the relative positions and dimensions of the telescope's ocular lens view and telescope reticle with the virtual reticle displayed in the camera viewscreen of the screen display.

4. In the configure mode, the virtual reticle 30 may have its crosshair centre 40 permanently aligned with the centre of the camera viewfinder, e.g., as shown in FIG. 6, while the scope reticle 10 can be resized to suit. The camera view of the ocular lens 52 of the scope 50, and therefore the incorporated reticle 10 of the scope 50, can be both resized as well as moved, utilising common touch-screen finger touch, swipe and pinch movements, etc., to align with the virtual reticle 30. The software application may also assist with this operation, through image recognition routines and relative movement of the different coordinate spaces of the overlay signal and the image 18 being output from the scope 50 and seen through the digital camera 72. For example, there may be some snap-to-fit functionality.

Figure 7:
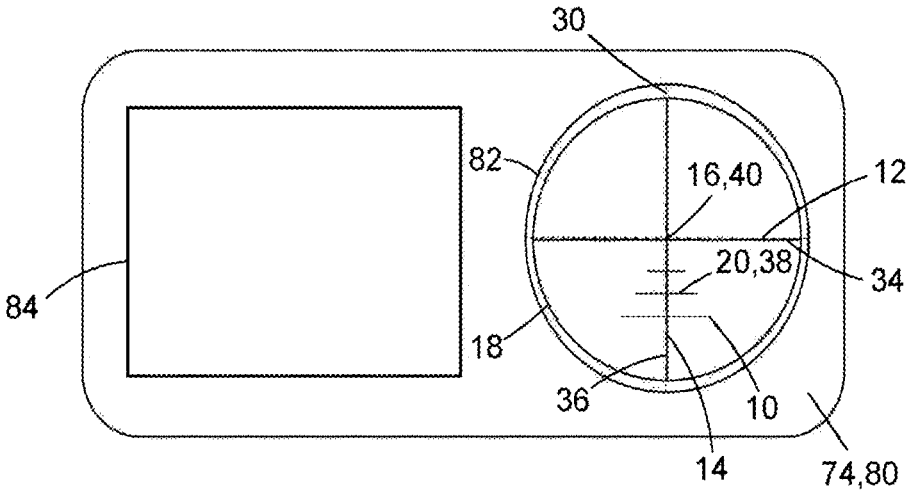
FIG. 7 is an exemplary illustration of the screen display illustrating the near alignment of the reticles and near completion of the configuration process (a slight misalignment of the telescope reticle and virtual reticle can still be seen)

5. When the physical scope reticle 10 is near completely aligned with the virtual reticle 30, the two are barely distinguishable on screen as individual entities. FIG. 7 provides an illustration of this where the image of the scope reticle 10 and surrounding area of the scope targeting view 18 is centralised within the camera viewing display 82 of the smartphone application and aligned with the virtual reticle 30 both dimensionally and in terms of position, within the realms of the operator's skill to align the images.

Figure 8:
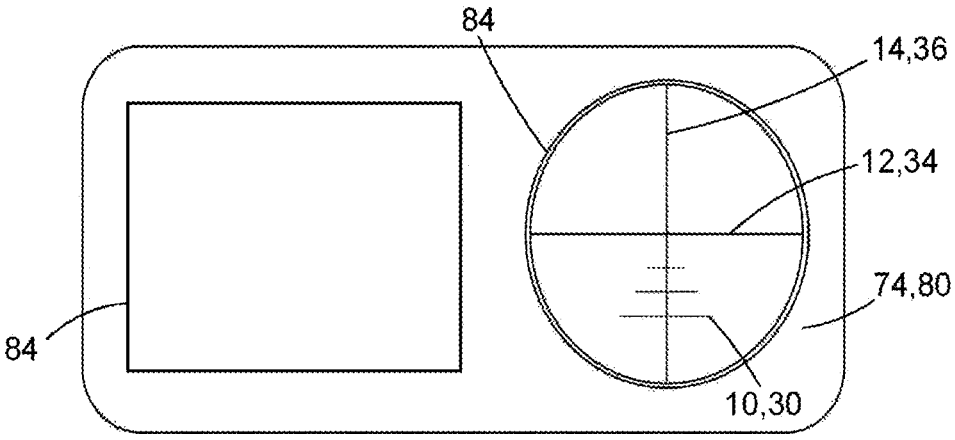
FIG. 8 is an exemplary illustration of the screen display showing the telescope reticle fully aligned with the virtual reticle and the smartphone application switched to an operate mode where the virtual reticle is made invisible (switched off)

6. When the physical reticle 10 is aligned with the virtual reticle 30 (either completely or as near to completely aligned as satisfies the operator), the smartphone application is put into an 'operate' mode to hide the virtual reticle 30. At this point the first coordinate space of the image 18 output from the scope 50 is locked to the second coordinate space of the digital overlay 80. The actual physical scope reticle 10, by virtue of the correctly sized and aligned camera view of the reticle 10, remains perfectly aligned with the now hidden virtual reticle 30 and any associated output in the digital overlay 80 (which remains visible or is made visible). In this operate mode, the virtual reticle 30 may be 'hidden' from view, in the sense of the virtual reticle 30 no longer being visible to the operator when using the smartphone 70 in its normal way. The virtual reticle 30 may have an opacity percentage assigned to it and the value of the opacity percentage may be reduced to below 5%, preferably below 1% and more preferably reduced to zero. The virtual reticle 30 may instead be removed from the digital overlay 80, i.e., the virtual image that the operator sees on the smartphone screen 74, such that the virtual reticle 30 is switched off or otherwise made invisible to the operator in the smartphone application. At that point, the digital overlay 80 being displayed on the electronic display device 70, for example, in the camera viewscreen 82, is then a combination of the actual scope image 18 and information from the smartphone application, but not the virtual reticle 30. The smartphone based application is now ready for operation as, for example, a ballistics and/or range-finding application, and the operator can then rely on the digital display 74 of the actual scope reticle 10 for the targeting and range finding operations assisted by an aiming indicator 32. FIG. 8 shows the set-up smartphone application with the virtual reticle 30 no longer visible in the screen image 82.

7. When used as a ballistics function, the configured and correctly aligned physical reticle 10 overlaid with an invisible, precisely-mapped virtual display in the same coordinate space as the virtual reticle 30, can incorporate a visible aiming-pointer 32 within the same coordinate space of the virtual reticle 30. The visible aiming-pointer 32 is therefore now mapped with the physical scope reticle 10 in the camera viewscreen 82, e.g., as an overlay, and can then be used to instruct, through its visual representation, inform the shooter exactly where to aim for maximum accuracy based on ballistics parameters. The shooter can input various projectile and environmental characteristics, of which the most significant might be the range to target, and wind speed and direction, upon which the position of the aiming indicator 32 is adjusted in terms of position accordingly (i.e., automatically). FIG. 9 shows an illustration of an exemplary smartphone screen display with the additional ballistics and targeting information 84 incorporated, for example, to one side of the viewscreen 82 on the electronic display device 74. That region 84 is shown in FIG. 9 displaying a "Range to Target" value, in that case of 800 yards, a "Wind Speed" value, in that case of 7 mph, and a "Wind Direction" value, in that case of "90° (From 3 o'clock)".

8. When used within a range-finding function, the configured and correctly aligned, physical, scope reticle 10, as displayed in the viewscreen 82 of the display device 74 with the overlaid invisible, precisely-mapped, virtual reticle 30 in the locked coordinate space of the digital overlay 80 provided by the software application can incorporate additional digital tools for the operator that move with the first coordinate space of the scope image 18. For example, a visible virtual measurement calliper tool 90 may be provided within the same coordinate space of the virtual reticle 30, and therefore of the mapped physical reticle 10, in the camera viewscreen 82. Utilising the touch-screen 74 of a programmable digital camera interface, the operator can "pinch" the virtual measurement caliper tool 90 in order to measure the size, in angular units, of a distant object 92 captured within the telescope's field of view using a pair of caliper arms 94. Due to the physical telescope reticle 10 that is within the camera viewscreen 82 being mapped to the software-provided virtual reticle 30, i.e., the first coordinate space is mapped to the second coordinate space, it is possible for the measurement caliper 90 to determine exactly how many angular units of measurement the distant object 92 spans according to the physical reticle 10 dimensions. Knowing the angular span of the object 92 within the telescopic sight view 18, and the actual true size of the object 92 is enough for the calculation to estimate the distance to the object 92. FIG. 10 is an illustration of an exemplary embodiment with a virtual caliper tool 90 visible in the same coordinate space of the mapped physical reticle 10. In the region 84, a mini-display of "Distance to Object" value is displayed as 475 yards in that example. The region 84 also includes a display which identifies the type of known object, in that case a "Golf Ball" and provides a "Size" value for the golf ball which is stated as 1.680 inches. Other configurations and parameters are possible since these are a function of the digital overlay 80, i.e., the screen display.

9. FIG. 11 shows a side view of an exemplary apparatus comprising an electronic display device 70 provided with an electronic display 74 and a digital camera 72 mounted to the ocular lens 52 of a scope 50 by one or mounts 76. The scope 50 is directed towards a Target. The electronic display device runs a software application (a computer program product) which operates as described above to generate the digital overlay 80 and virtual reticle 30 which can be used to align the coordinate space of the scope 50, such that additional digital functionality can be added to the scope 50.

A further development through this system is made available by adding an automatic object recognition enhancement to the range-finding functionality, as shown with respect to FIG. 12.

The information shown in FIG. 12 is identical to FIG. 10 except for the omission of the virtual measurement caliper tool (90 in FIG. 10) and the tool's caliper arms (94 in FIG. 10).

Instead, there is a rectangular auto-recognition box 100 around the known distant object (92 in FIG. 10, 102 in FIG. 12). This box 100, similar to the facial-recognition boxes standard within modern digital cameras is supplied by third-part Artificial Intelligence (AI) software available from most major suppliers (Microsoft, Apple, Google, etc.).

The difference this addition brings to the embodiment described above is that instead of utilising the digital calibre tool to manually select and pinch-measure an object, AI can recognise an object (as one of any number of objects it has been "trained" to do so). The operator can simply point to an object on the touch-screen, indicating to the application that the selected object is to be used for ranging.

The AI tool can supply the object size in screen coordinates and then the same operation(s) as described above using the manual virtual caliper tool can be implemented. In the example of FIG. 12, the object 102 is a golf ball that is visible in the image. The operator has positioned the virtual selection tool 100, in this case a rectangle 100, over the object 102. The AI tool uses object recognition software to identify the object 102 as a golf ball. The identified object 102 is specified on the viewscreen in box 104 as "golf ball". The software uses the recognised object term to search for known dimensions of the object 102 such as the standard diameter of a golf ball, for example, by performing an automated internet search or by searching through a library of data records. The dimension of the object 102 is then used in the same way as the caliper reading described above to provide range information. All other features are as described above.

Thus, FIG. 12 provides an embodiment where dimensions such as range can be assessed based on recognisable objects in the field of view using the mapping function of the different dimensional spaces.

I claim:

1. A method of adding digital functionality to a scope, the method comprising:

coupling a digital camera of an electronic display device to an ocular lens of the scope;

outputting an image output at the ocular lens of the scope that is received by the camera, the scope adding a scope reticle to the image, wherein the scope reticle is a stadiametric reticle comprising stadiametric markings;

displaying the image on an electronic display of the electronic display device for an operator to view, the image being displayed in a first coordinate space;

generating a digital overlay for the electronic display that includes a virtual reticle which is visible to the operator in a configure mode, the digital overlay being displayed in a second coordinate space, wherein the virtual reticle is a stadiametric reticle comprising stadiametric markings;

combining on the electronic display the digital overlay in the second coordinate space with the image output from the scope in the first coordinate space;

allowing dimensional and positional adjustment of the first coordinate space relative to the second coordinate space to align the scope reticle with the virtual reticle in the digital overlay, so that the stadiametric markings of the virtual reticle become aligned with and overlay the stadiametric markings of the scope reticle in x-and y-directions in the configure mode;

locking the first coordinate space of the image output from the scope to the second coordinate space of the digital overlay upon switching the electronic display device from the configure mode to an operate mode, wherein locking the first coordinate space to the second coordinate space comprises digitally linking coordinates from the first coordinate space to coordinates from the second coordinate space, such that a scaling factor becomes set for mapping the coordinates of the first coordinate space onto the coordinates of the second coordinate space; and reducing visibility of the virtual reticle in the digital overlay with respect to the image output from the scope in the operate mode in order to reveal the scope reticle on the electronic display for the operator.

2. The method as claimed in claim 1, further comprising:

integrating information in the digital overlay that is visible to the operator in at least the operate mode, when the first coordinate space is locked with the second coordinate space, the information being provided to assist the operator in targeting determination and/or range determination, wherein the information comprises providing an aiming indicator in the second coordinate space of the digital overlay that becomes mapped to the first coordinate space through the locking of the first and second coordinate spaces, such that the aiming indicator moves with the first coordinate space in common with changes at the scope in order to provide a virtual aim point for the scope reticle.

3. The method as claimed in claim 2, wherein a position for the aiming indicator in the second coordinate space is determined based on a current target position of the scope and on parameters input to the electronic display device which alter the aim point for the operator.

4. The method as claimed in claim 3, further comprising inputting parameters which are indicative of weather conditions and/or atmospheric conditions between the scope and a target, and/or of ballistic properties of a projectile to be fired at the target, the parameters being used to determine a position of the aim point in the second coordinate space.

5. The method as claimed in claim 2, wherein the information comprises a virtual tool for assisting with the range determination, the virtual tool allowing dimensions to be measured in the first coordinate space via the second coordinate space and specifying the measured dimensions on the electronic display in units relevant to the first coordinate space, and wherein the virtual tool uses a software product which is configured to recognize an object selected in the image, look up one or more dimensions for the recognized object, apply the one or more dimensions in the second coordinate space when determining a range in the first coordinate space, and specifying the one or more dimensions on the electronic display in units relevant to the first coordinate space.

6. The method as claimed in claim 5, wherein the virtual tool is represented in the second coordinate space as a virtual caliper tool, and wherein, the virtual caliper tool is used to measure a dimension of a physical object of known size which is visible in the image, and wherein a distance to the object is determined from the measured dimension using the known size of the physical object and a scaling factor used for mapping dimensions in the first coordinate space to the second coordinate space.

7. The method as claimed in claim 1, wherein the reducing visibility of the virtual reticle is performed by switching off or switching out the virtual reticle from an overlay signal so that the virtual reticle no longer appears in the digital overlay.

8. The method as claimed in claim 1, wherein the reducing visibility of the virtual reticle is performed by transforming the virtual reticle from an opaque reticle to a transparent reticle in an overlay signal by reducing an opacity percentage assigned to the virtual reticle to less than one.

9. The method as claimed in claim 1, wherein the reducing visibility of the virtual reticle is performed by reducing a line thickness of the virtual reticle relative to the scope reticle, such that the virtual reticle fits entirely within an outline of the scope reticle, and changing a color of the virtual reticle from a contrasting color to a matching color of the scope reticle so that the operator only sees the scope reticle.

10. The method as claimed in claim 1, further comprising a step of selecting the virtual reticle from a database of virtual reticles, wherein the virtual reticle is selected on the basis of the virtual reticle matching a format of the scope reticle for at least 75% of the scope reticle.

11. The method as claimed in claim 10, wherein the virtual reticle is selected on the basis of the virtual reticle being identical in format to the scope reticle.

12. The method as claimed in claim 10, wherein the selecting is performed automatically following one of:

determining a make and model of the scope from data stored in an operator profile file;

using an image recognition routine on the scope reticle in the image output from the scope;

using an image recognition routine on an image of the scope seen through the digital camera before coupling the electronic display device to the scope; or scanning a barcode, QR code or other mark using the digital camera of the electronic display device to identify the scope.

13. The method as claimed in claim 1, wherein the digital overlay is configured to provide a camera viewscreen with a live feed from the digital camera in a region of the electronic display showing the image of the scope reticle captured from the ocular lens of the scope.

14. An apparatus for adding digital functionality to a scope, the apparatus comprising:

a scope having an ocular lens, the scope including a scope reticle such that an output from the ocular lens of the scope comprises an image with the scope reticle, wherein the scope reticle is a stadiametric reticle comprising stadiametric markings;

an electronic display device comprising a digital camera and an electronic display for an operator to view, the electronic display device being mountable on the scope to capture the image output from the scope to display on the electronic display in a first coordinate space; and a computer program product including a set of non-transitory computer-readable media having a set of instructions which, when executed by processing circuitry of the electronic display device, cause the processing circuitry to perform a method of adding the digital functionality to the scope output observed on the electronic display through generating a digital overlay for the electronic display device that includes a virtual reticle which is visible to the operator in a configure mode of the electronic display device, the digital overlay being displayed in a second coordinate space, wherein the virtual reticle comprises stadiametric markings, the method comprising:

combining the digital overlay with the output from the scope in the electronic display on the electronic display device;

allowing dimensional and positional adjustment of the first coordinate space relative to the second coordinate space so that the stadiametric markings of the virtual reticle become aligned with and overlay the stadiametric markings of the scope reticle in x-and y-directions in the configure mode;

locking the first coordinate space of the image output from the scope to the second coordinate space of the digital overlay upon switching the electronic display device from the configure mode to an operate mode, wherein locking the first coordinate space to the second coordinate space comprises digitally linking coordinates from the first coordinate space to coordinates from the second coordinate space, such that a scaling factor becomes set for mapping the coordinates of the first coordinate upon switching the electronic display device from the configure mode to an operate mode, reducing visibility of the virtual reticle in the digital overlay with respect to the image output from the scope in the operate mode of the electronic display device in order to reveal the scope reticle on the electronic display for the operator.

15. The apparatus as claimed in claim 14, wherein information incorporated in the digital overlay is visible to the operator in at least the operate mode, when the first coordinate space is locked with the second coordinate space, the information being provided to assist the operator in targeting determination and range determination.

16. The apparatus as claimed in claim 14, wherein in at least the operate mode an aiming indicator is provided for the operator by the digital overlay for use with the scope reticle.

17. The apparatus as claimed in claim 14, wherein the computer program product includes a database of virtual reticles and is configured to enable the virtual reticle to be selected from the database of virtual reticles so that the virtual reticle matches the scope reticle of the scope.

18. The apparatus as claimed in claim 14, wherein the virtual reticle comprises an image model of the scope reticle which is added into an overlay signal by the computer program product for producing the digital overlay during the configure mode, and which is switched off or out of the overlay signal in the operate mode so that the virtual reticle is no longer visible to the operator.

19. The apparatus as claimed in claim 14, wherein the computer program product is configured to display a camera viewscreen in a first region of the electronic display and ballistics information in a second region of the electronic display, the camera viewscreen displaying the image that is output from the scope that includes the scope reticle.

20. A computer program product including a set of non-transitory computer-readable media having a set of instructions which, when executed by processing circuitry of an electronic display device, cause the processing circuitry to perform a method of adding digital functionality to a scope, the electronic display device having a digital camera coupled to an ocular lens of the scope, the scope arranged to output an image at the ocular lens of the scope that is received by the camera, the scope adding a scope reticle to the image, the scope reticle being a stadiametric reticle comprising stadiametric markings, the method comprising:

displaying the image on an electronic display of the electronic display device for an operator to view, the image being displayed in a first coordinate space;

generating a digital overlay for the electronic display that includes a virtual reticle which is visible to the operator in a configure mode, the digital overlay being displayed in a second coordinate space wherein the virtual reticle comprises stadiametric markings;

combining on the electronic display the digital overlay in the second coordinate space with the image output from the scope in the first coordinate space;

allowing dimensional and positional adjustment of the first coordinate space relative to the second coordinate space to align the scope reticle with the virtual reticle in the digital overlay, so that the stadiametric markings of the virtual reticle become aligned with and overlay the stadiametric markings of the scope reticle in x-and y-directions in the configure mode;

locking the first coordinate space of the image output from the scope to the second coordinate space of the digital overlay upon switching the electronic display device from the configure mode to an operate mode, wherein locking the first coordinate space to the second coordinate space comprises digitally linking coordinates from the first coordinate space to coordinates from the second coordinate space, such that a scaling factor becomes set for mapping the coordinates of the first coordinate space onto the coordinates of the second coordinate space; and reducing visibility of the virtual reticle in the digital overlay with respect to the image output from the scope in the operate mode in order to reveal the scope reticle on the electronic display for the operator.

* * * * *